US005447226A

United States Patent [19]

Laine

[11] Patent Number: 5,447,226

[45] Date of Patent: Sep. 5, 1995

[54] DUAL COMPARTMENT CONTAINER WITH MEANS FOR MIXING AND DISPENSING A PRODUCT

[75] Inventor: Pascal Laine, Enghien-les-Bains, France

[73] Assignee: Societe de Conseils et D'Etudes des Emballages (S.C.E.E.), Soisy-sous-Montmorency, France

[21] Appl. No.: 182,176

[22] PCT Filed: Jun. 8, 1993

[86] PCT No.: PCT/FR93/00545

§ 371 Date: Feb. 3, 1994

§ 102(e) Date: Feb. 3, 1994

[87] PCT Pub. No.: WO93/25454

PCT Pub. Date: Dec. 23, 1993

[30] Foreign Application Priority Data

Jun. 9, 1992 [FR] France ..... 92 06934
Nov. 2, 1992 [FR] France ..... 92 13091

[51] Int. Cl.[6] ..... B65D 25/08; B67D 5/60

[52] U.S. Cl. ..... 206/219; 215/DIG. 8; 222/129; 222/145.6

[58] Field of Search ..... 222/129, 145; 206/219, 206/222, 221; 215/8

[56] References Cited

U.S. PATENT DOCUMENTS 2,533,806 12/1950 Holzapfel .
2,787,268 4/1957 Greenspan ..... 206/221
2,813,649 11/1957 Lipan ..... 215/DIG. 8
3,221,917 12/1965 De Santo et al. ..... 215/DIG. 8
3,651,990 3/1972 Cernei ..... 206/221 X
4,682,689 7/1987 Pereira et al. .
4,757,916 7/1988 Gonclaves .
4,936,446 6/1990 Lataix ..... 206/221
5,088,627 2/1992 Musel .

FOREIGN PATENT DOCUMENTS 0243730 11/1987 European Pat. Off. .
0260179 3/1988 European Pat. Off. .
2663304 12/1991 France .

*Primary Examiner*—Bryon P. Gehman
*Attorney, Agent, or Firm*—Sandler, Greenblum & Bernstein

[57] ABSTRACT

A mixer-conditioner for two components to be separately stored and extemporaneously mixed on their first utilization. The system comprises two compartments, each containing one of the components, an obturation element providing a tight seal between said compartments, the obturation element being movable between a closed position and an open position and arranged, when in the closed position, in a communication passage between the compartments, and being integral with a connection element engaged with a rotary actuation member whose operation causes the opening of the communication passage between the compartments by displacement of the obturation element in order to enable mixing of the components. The connection element is rotationally integral with the actuation member, but translationally free and guided, and the obturation element and the connection element comprise a screwing system comprising screw threads or at least one projection which cooperate with screw threads or at least one projection on the mixer conditioner such that the rotation of the actuation member causes the unscrewing of the obturation element or the connection element as well as the lifting of the obturation element which is disengaged from its closed position, while the connection element slides into the actuation member.

19 Claims, 4 Drawing Sheets

FIG.5
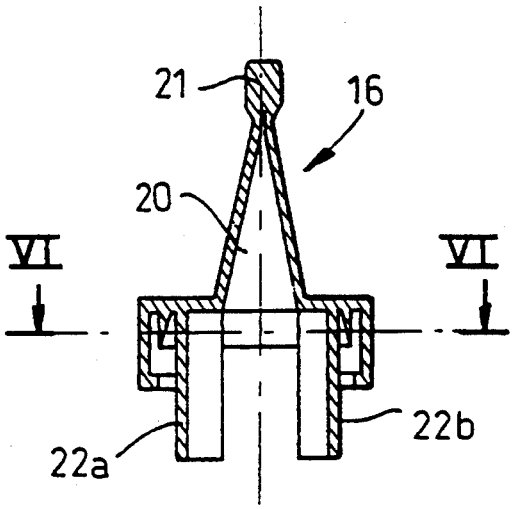
FIG.4
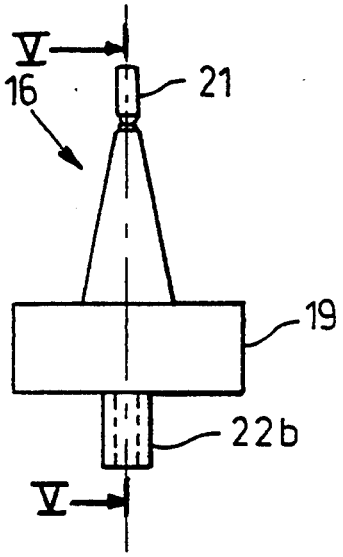
FIG.6
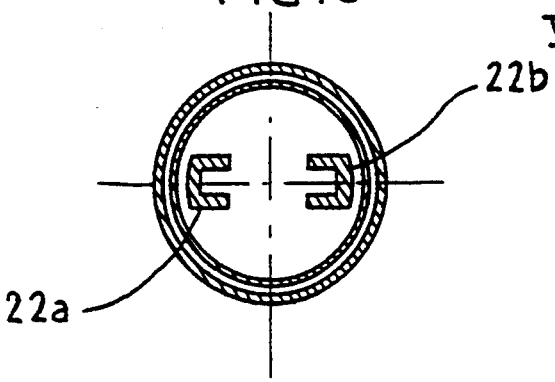
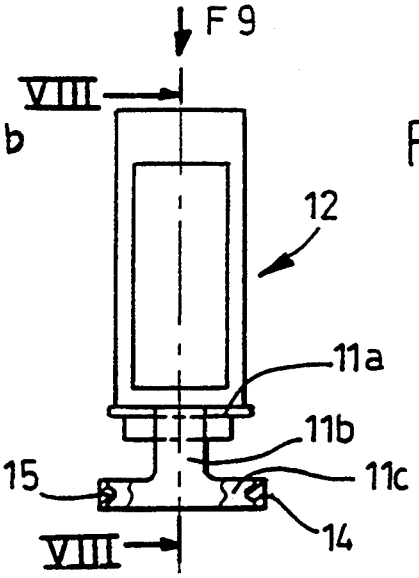
FIG.7
FIG.8
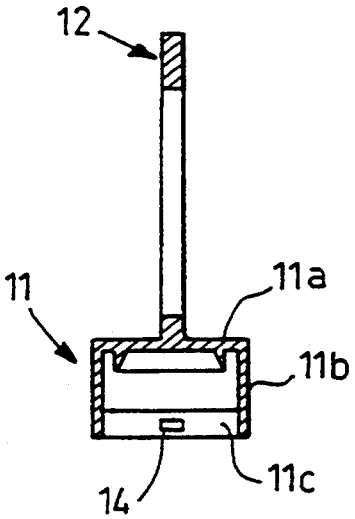
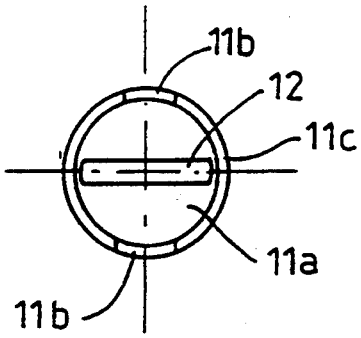
FIG.9

FIG.10
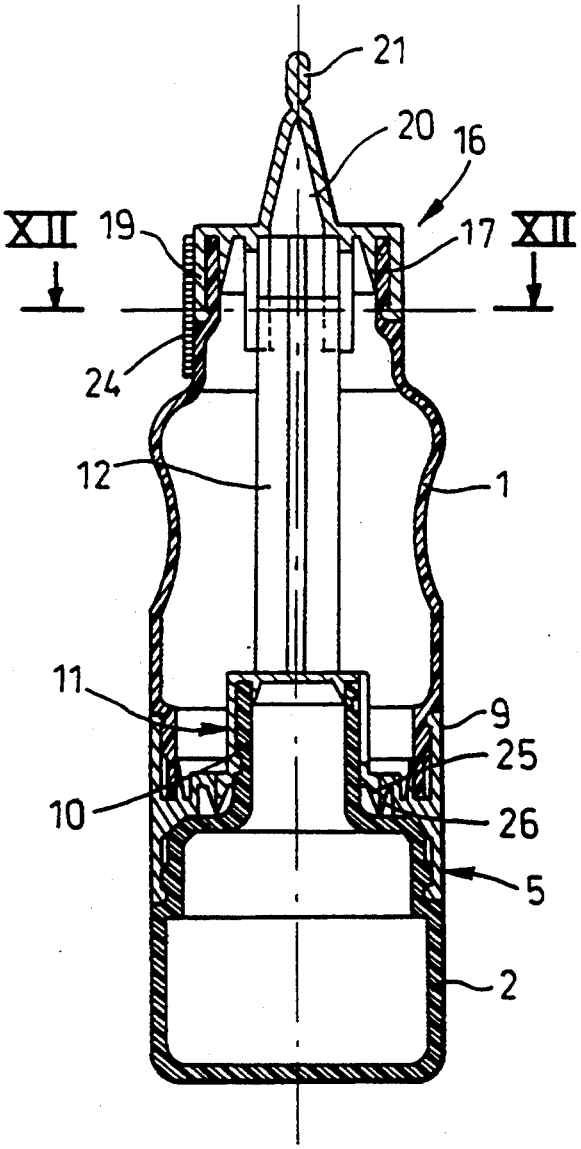
FIG.11
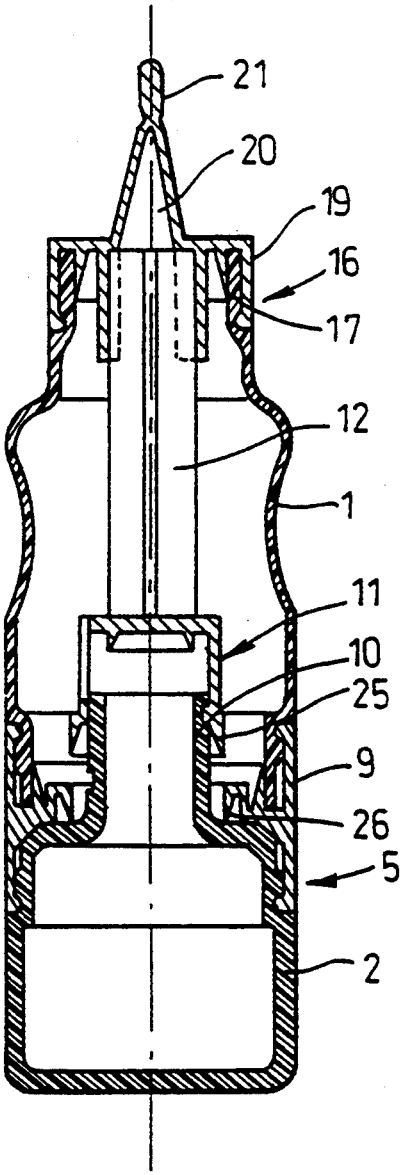
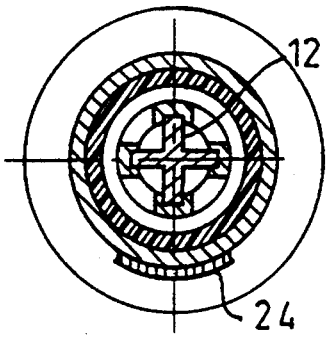
FIG.12

FIG.14
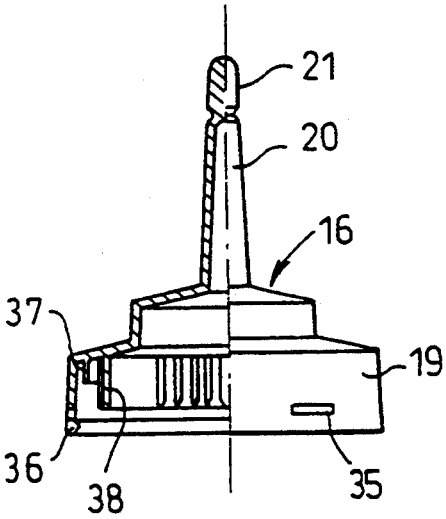
FIG.15
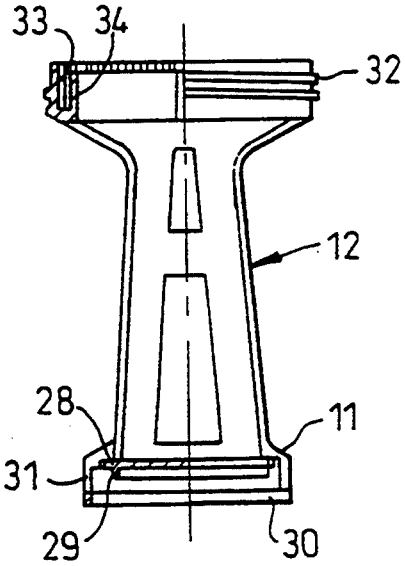
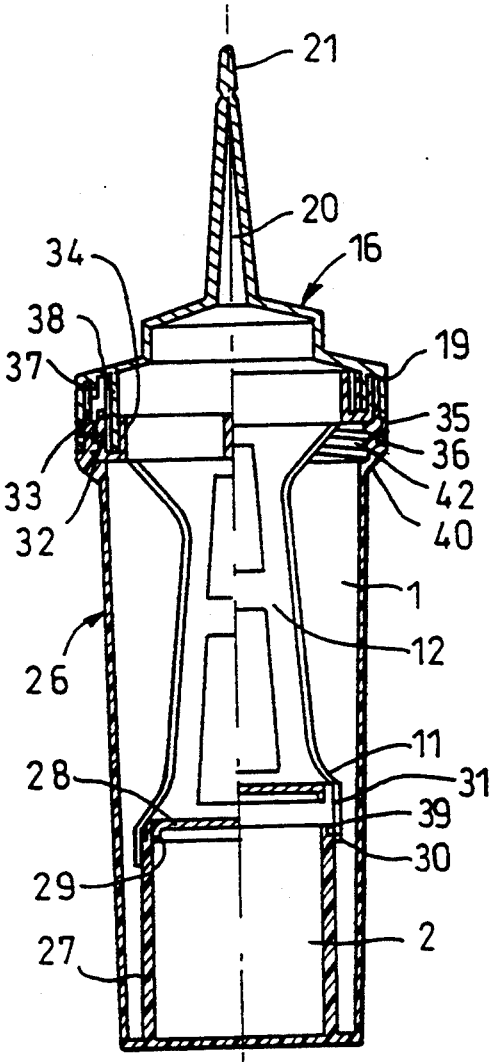
FIG.13
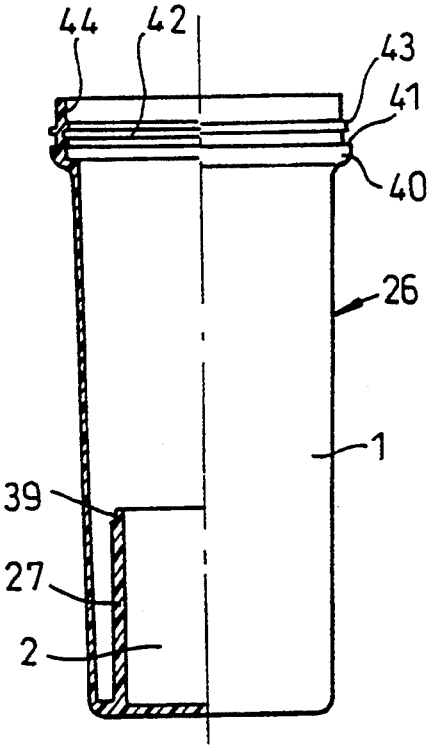
FIG.16

DUAL COMPARTMENT CONTAINER WITH MEANS FOR MIXING AND DISPENSING A PRODUCT

BACKGROUND OF THE INVENTION

1. Field of the Invention

The invention concerns a mixer-conditioner for two components to be stored separately and to be mixed extemporaneously on the first utilization, provided with two compartments, each containing one of the components, an obturation means providing a tight separation and arranged in a communication passage between said compartments, and an opening system of said obturation means to open said communication passage at will between the compartments, and to enable the components to be mixed.

The mixer-conditioner according to the invention is especially intended, for example, for separate storage of a coloring agent and an oxidant for dyeing hair or also a powder and a liquid for pharmaceutical products, or other veterinary and pharmaceutical products of the extemporaneous-mixing type.

Indeed, there are products of this type which must be mixed only at the moment of the first utilization.

2. Description of Background Information

There is a great number of this type of conditioner.

According to a known technique, the obturation means between the compartments is constituted by a membrane or sealed cap, whereas the opening system comprises a perforation and/or cutting means of said cap. A system of this type is described in the document EP-A-0260179, for example.

According to another technique, the obturation means is a stopper, whereas the opening system enables expulsion of said stopper (by an unscrewing operation, for example), said stopper then remaining in one of the conditioner compartments.

One has also envisioned devices in which the opening system comprises a connection element which is integral with the obturation means, and which is engaged with a rotary actuation member whose operation causes the opening of the communication passage by displacement of the obturation means.

This, for example, is the case in the device described in document EP-A-0243730, in which the obturation means, in the form of a stopper, is pushed towards the bottom by a connection rod when the actuation member is being screwed.

The device described in document U.S. Pat. No. 5,088,627 also comprises a stopper and a connection element which is tubular, in addition to being integral with the actuation member such that the opening is undertaken by unscrewing of the actuation member.

In the two cases mentioned hereinabove, it is understood that the actuation member has a spiral movement, i.e., combined rotational and longitudinal translational movements.

In addition, in these known devices, the compartments are obtained in a single container, the communication passage originating from a narrow portion of the container, which results in substantial difficulties to overcome in order to obtain a good impermeability.

SUMMARY OF THE INVENTION

The invention concerns a device of the general type previously mentioned above, and which additionally comprises, as mentioned hereinabove, a connection element which is integral with the obturation means, and which is engaged with a rotary actuation member whose operation causes the opening of the passage by displacement of the obturation means.

However, this device is characterized in that the connection element is rotationally integral with the actuation member, but translationally free and guided, whereas the obturation means and/or the connection element comprise a screwing system such that the rotation of the actuation member causes the unscrewing of the obturation means and/or the connection element, and the lifting of said obturation means which is disengaged from its closing position whereas said connection element slides into the actuation member.

Preferably, the communication passage is a conduit forming a tubular skirt or neck, and the obturation means is a cap which is moveable from an open position to a closed position, which, when in the closed position, closes said conduit by pressing onto the latter.

According to one embodiment, each compartment is constituted by a separate container, said containers being tightly connected to one another by a junction ring.

In this case, for example, the communication conduit onto which the cap is pressed is constituted by a neck of one of the containers, which is introduced into an open end of the other container.

However, according to another embodiment, the communication conduit onto which the cap is pressed is constituted by a tubular skirt of the junction ring, which opens by its two ends into the opposite openings arranged on the containers. More specifically in this case, the openings opposite the containers are constituted by necks, onto each of which the junction ring is tightly fitted, whereas the tubular skirt of said ring extends into one of the containers from the connection plane of said containers.

Another embodiment whose compartments originate from the same container body, is characterized in that one of the compartments is constituted by a tube which projects into said container from the bottom of the latter, the other compartment being obtained by the container volume outside of the tube, whereas the obturation means, when at rest, closes the outlet of said tube.

The communication conduit between the compartments or the tube forming one of the compartments, comprises for example, a spiral ramp intended to cooperate with a conjugated unscrewing means provided on the cap, such that the operation of the actuation member forces the cap to move away from said conduit or said tube according to a spiral movement.

In this case, the cap can comprise an obturation disk connected by fastening hooks to a ring intended to surround the communication conduit or the tube forming one of the compartments, and which is provided with the conjugated unscrewing means.

In order to prevent any additional closure between the compartments after mixing of the components during the first utilization, the conjugated unscrewing means comprises at least one guiding lug for example, whereas the spiral ramp is open at the end of the conduit on which it is arranged, such that the guiding lug or lugs of the cap escape therefrom at the end of the path, preventing, after opening, any subsequent closure by said lug or lugs returning into the ramp. Advantageously, the end of the spiral ramp has an asperity intended to be easily crossed by the lug or lugs during opening, but which reinforces the prevention of an ill-timed return into said ramp.

According to a particular embodiment, the actuation member is mounted to one of the ends of one of the compartments, and the connection element comprises, on the side engaged with the actuation member, a screw-ring intended to cooperate with a conjugated threading arranged at the corresponding end of said compartment. In this case of course, it is not necessary to provide a screwing means on the conduit or the tube forming the container.

The actuation member advantageously has a ring, mounted rotationally free, accessible from the outside, and provided with slides which extend into said compartment, and which act as a rotational engagement and translational guiding means for the connection rod of the cap, the length of said slides being sufficient to enable said connection element to move between the respective closing and opening positions of said obturation means.

The ring, accessible from the outside, can also be provided with an annular gear which acts as a rotational engagement and translational guiding means for the connection element provided, for this purpose, with conjugated grooves.

Preferably, in this case, the actuation member covers and closes an opening of the compartment onto which it is mounted in a capsule-like manner, and comprises an opening for distributing the product obtained from the mixture of the components, which opening is temporarily closed.

BRIEF DESCRIPTION OF THE DRAWINGS

Other particularities will become apparent (the shape of the connection element, for example . . . ) in perusal of the following description with reference to annexed drawings, wherein:

FIG. 4 is an elevated view of the actuation member of the opening system of the device in the preceding FIGS., FIG. 5 is a section according to V—V of FIG. 4, FIG. 6 is a section according to VI—VI of FIG. 5, FIG. 7 shows, in elevation, the obturation cap and its connection element, FIG. 8 is a section along VIII—VIII of FIG. 7, FIG. 9 is an end view along the arrow F9 of FIG. 7, FIGS. 10 and 11 are longitudinal sections of another embodiment according to the invention in storage and utilization positions, respectively, FIG. 12 is a section along XII—XII of FIG. 10, FIG. 13 is a longitudinal section of another embodiment similar to FIG. 1, FIGS. 14, 15 and 16 show an elevated half- section of the actuation member, the obturation cap and its connection element, and the two-compartment body of the device in FIG. 13, respectively.

DETAILED DESCRIPTION OF PREFERRED EMBODIMENTS OF THE INVENTION

Figure 1:
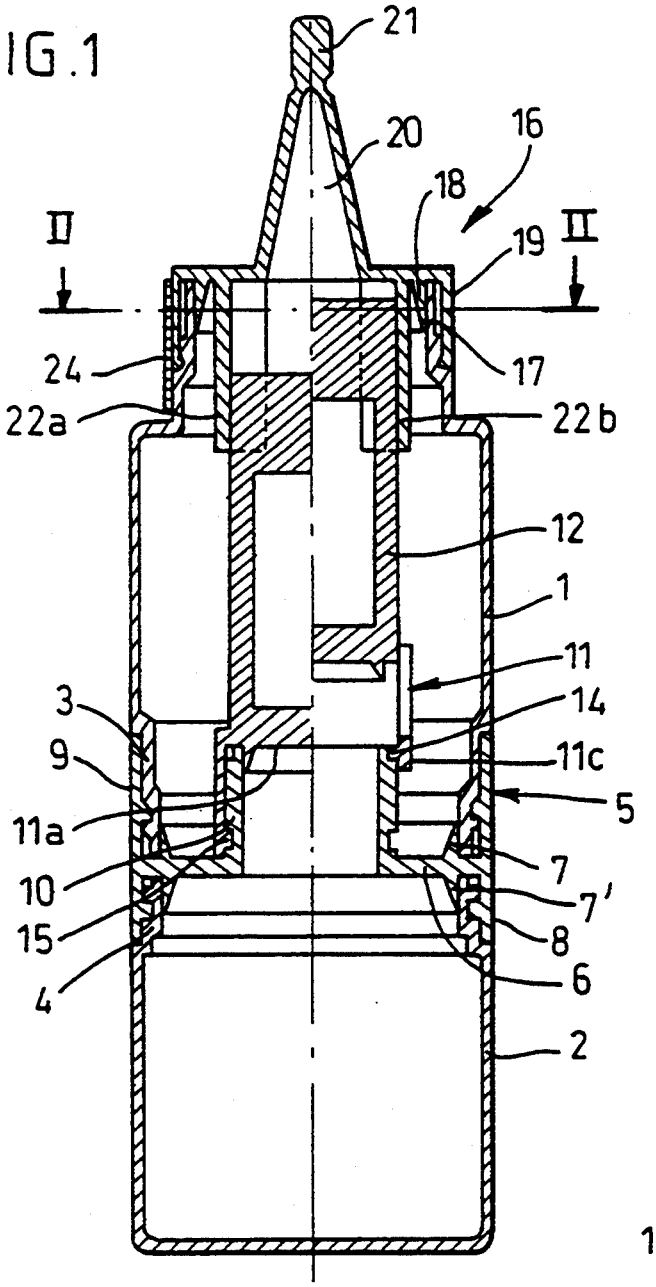
FIG. 1 is a longitudinal section of a first embodiment, or also a section along I—I of FIG. 2 (one half-section represents the device in storage position and the other half-section represents the device in utilization position)
Figure 3:
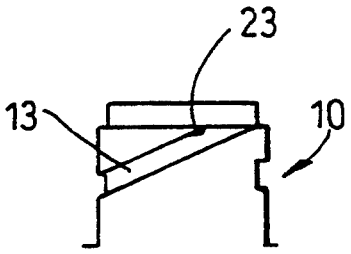
FIG. 3 shows, in elevation, a possible communication conduit between the two conditioner containers.
Figure 2:
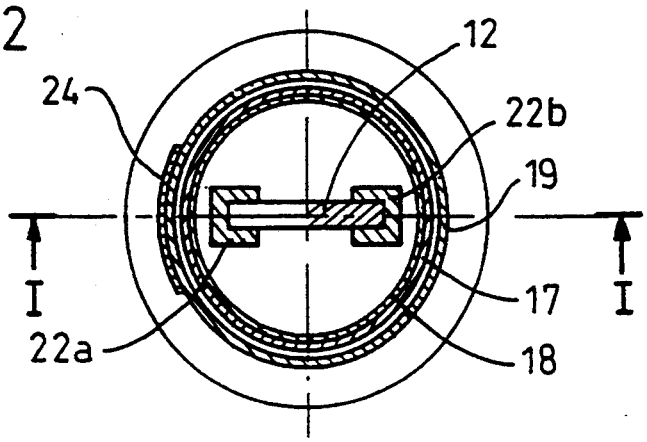
FIG. 2 is a section along II—II of FIG. 1.

The conditioner according to the invention, represented in FIGS. 1 to 9, comprises two compartments in the form of two containers, upper 1 and lower 2 respectively, of circular section in this case, connected to one another so as to have opposite openings demarcated by the necks 3 and 4, respectively. These necks, and more specifically the neck 4, can be narrower and connected to the corresponding container by a plate-like portion. The containers 1 and 2 are tightly connected by a junction ring 5 which, as shown in FIGS. 1 and 3, comprises a plate 6 which defines the junction plane of the necks 3 and 4, and from which impermeable skirts 7,7' internal to said necks 3 and 4 extend, the ring 5 also comprising connection crowns 8 and 9 which extend on either side of plate 6.

The plate 6 is circular in this case, and centrally pierced, and has a conduit 10 in the form of a tubular skirt which is coaxial to the necks 3 and 4, and which extends into the upper container 1. Of course, the shape of the plate 6 depends upon that of the containers (simple ring in this embodiment).

Thus, it is understood that the two containers 1 and 2 can communicate with one another by said conduit 10.

An obturation means of said conduit is constituted by a cap 11 provided with an element or a connection rod 12, here in the form of a centrally perforated plate, the cap 11 and the plate 12 being more specifically represented in FIGS. 7 to 9.

The cap 11 comprises an obturation disk **11*a* connected by fastening hooks 11*b* (FIG. 10) to a ring 11*c* (FIGS. 9 and 10**).

As is clearly shown in FIG. 1, the ring **11*c* is intended to surround the conduit 10 whereas the disk 11*a*** enables it to be closed (left portion of said figure).

As is shown more specifically in FIG. 3, the conduit 10 has a spiral ramp 13 or threading, which is intended to cooperate with internal lugs 14,15 or similar, arranged in the ring **11*c***.

Thus, a rotation in the unscrewing direction, of the cap 11 causes a spiral movement which distances the disk **11*a* from the conduit 10**.

In order to rotationally drive the cap 11, the invention provides an actuation member 16, more specifically represented in FIGS. 4–6.

The actuation member 16 is engaged with the connection plate 12 of the cap 11 as will be seen in more detail hereafter.

The actuation member is shaped like a capsule, and it covers and closes an opening of the upper container 1, opening demarcated by a neck 17.

As is represented in FIG. 1, the member 16 is tightly mounted in the neck 17 of the container 1, by a skirt 18 for example, and also rotationally free and actionable by means of a ring 19 which surrounds said neck 17.

In addition, the member 16 comprises an opening 20 for distributing the product obtained after mixing; here, it is temporarily closed by a detachable tip 21 (it could also be a removable stopping means).

The member 16 is provided with two gutter-shaped (FIG. 6) slides **22*a*,22*b* which extend toward the inside of container 1, and which are intended to guide the edges of the plate forming the connection element 12**.

Since the edges of plate 12 are engaged in said slides, it is clear that a rotation of member 16 (by means of its ring 19) causes a rotation of plate 12 and cap 11.

The previously mentioned spiral movement of cap 11 (by virtue of ramp 13 and lugs 14,15) is possible due to the freedom of translational movement of plate 12 in the slides 22*a*,22*b*.

The length of slides 22*a* and 22*b* and of plate 12 are calculated so that the latter has sufficient clearance space to pass from the low obturation and storage position (left side of FIG. 1) to the raised opening position (right side of said FIG. 1).

Furthermore, as represented in FIG. 3, the spiral ramp 13 is open, i.e., the lugs of the cap can escape at the end of the path. An asperity such as 23 (FIG. 3) can be additionally provided for the reasons which will be recalled hereafter.

The utilization is simple to understand.

The lower container 2 is filled with powder or liquid.

The container 2 is then closed by the positioning of the cap 11 and its plate 12, until the disk 11*a* presses hermetically on the conduit 10 (the lugs 14,15 being arranged in the ramp 13).

The container 1 is then filled and closed with the member 16 forming the capsule, by fixing the ring 19 on the outside of neck 17 taking care that the slides 22*a*, 22*b* engage correctly with the plate 12.

In order to avoid any risk of ill-timed opening, one can provide any kind of inviolable means such as a protective cap or also tags, plates, or the like, straddling the ring 19 of the member 16 and a wall of the container 2, like the tag 24 represented in FIG. 1.

Thus, for the first utilization, after tearing off the tag 24, the ring 19 is turned in the unscrewing direction (the rotation of the plate 12 in the component is facilitated owing to its central recess), as already explained, the cap 11 is thus lifted such that the two containers 1 and 2 communicate, and the components that they contain can be mixed (the components can pass through the fastening hooks 11*b* of the cap 11).

Then, in order to dispense the product derived from the mixture in the represented embodiment, it suffices to cut or break the tip 21.

It is important to note that, after unscrewing, the lugs 14,15 of the cap leave the spiral ramp 13, such that it is then no longer possible to re-close the conduit 10, the ring 19 then turning under vacuum.

The asperity 23 provided at the end of the path of ramp 13, and which is crossed by the lugs at the time of unscrewing, prevents any return of the lugs into said ramp.

This can be significant to avoid repositioning the device in the storage position after the mixture is obtained.

In the embodiment represented in FIGS. 10 to 12, the same references are used for similar means, and only the main references are mentioned.

This embodiment differs from the one described previously, mainly because the communication conduit 10 between the containers is constituted by a neck of the lower container 2, instead of a tubular skirt of the junction ring.

In addition, here the connection element 12 of the cap is in the form of a cross-shaped section rod, the slides of the member 16 then being 4 in number, for example.

Here, however, the junction ring 5 has no portion which can be inserted into the container 2, the impermeability thus being ensured by the cooperation of the skirts 25, 26 arranged respectively on the cap 11 and the ring 5 as shown in FIGS. 10 and 11.

It is clear that the constitutive materials of the containers can be varied, flexible or not, and different, in glass or PVC for example, for the lower container, and in flexible polyethylene for the other, etc. This is important, because depending upon the products to be mixed, the materials utilized for each compartment must be different in certain cases, such as, for example, with the utilization of an oxidizing product, which is not possible with the devices described in the documents EP-A-0243730 and U.S. Pat. No. 5,088,627 mentioned hereinabove.

Nonetheless, the invention also provides that the compartments can be obtained from an integral element. In this case, however, the invention suggests a completely original embodiment which avoids the disadvantages of the recipient whose compartments are obtained by a simple narrowing of said container, such a known device is generally manufactured by extrusion-blowing, whereas in the embodiment according to the invention which is represented in FIGS. 13 to 16, the body forming the two compartments can be obtained by injection molding.

of course, the embodiment represented in FIGS. 13 to 16 comprises an opening system of the type described in the preceding figures, however, with variations that could be utilized in the previously described embodiments; similarly, the opening system of FIGS. 1 to 12 could be utilized here.

For this embodiment (FIGS. 13 to 16), as for the one of FIGS. 10 to 12, the similar or equivalent means have the same references.

Thus, we rediscover especially two compartments 1 and 2, an obturation cap 11 integral with a connection element 12 engaged with an operation member 16 provided with a ring 19. We also rediscover the opening 20 and the tip 21. However, in this case, the two compartments 1 and 2 originate from the same container body 26, at the bottom of which a tube 27 projects, the compartments 1 and 2 being obtained by respective outer and inner volumes of tube 27, whereas the cap 11 is provided to close the outlet of said tube 27. The cap 11 comprises a plate 28, an impermeable inner skirt 29, and an outer guiding skirt 30 with opening 31.

It is understood that in this case the cap 11 is not provided with screwing means, since these means are provided on the connection element 12.

Indeed, if the connection element 12 is in the shape of a perforated plate as before, it is the one to comprise screwing means at its end opposite from the cap 11.

These screwing means are shaped like a screw-ring 32, more particularly visible in FIG. 15, and internally equipped with longitudinal grooves 33 and an impermeable skirt 34.

In addition, the ring 19 of the member 16 has slots 35 (FIG. 14) intended to obtain internal projections 36, whereas it is internally provided with an impermeable skirt 37 and an annular gear 38.

Furthermore, in the embodiment represented, it is noted that the ring 19 is connected to the conduit 20 by graded plates.

As shown again in FIG. 13, and more specifically in FIG. 16, the end of the inner tube 27 has a throat 39, and the open end of the container body 26 is provided with a ring 40 which is equipped with a base 41, an inner threading 42 and an outer rib 43, the portion 44 on top of the threading 42 being perfectly calibrated.

The three elements 16, 12 and 26 described above are advantageously manufactured by injection molding.

As in the other embodiments described, the fillings are simple.

The compartment 2 is initially filled with a first product and said compartment 2 is closed by the cap 11 and especially its impermeable skirt 29, during positioning of connection element 12 by screwing its ring 32 into the threading 42 of the ring 40 of the body 26.

Then, it suffices to condition the second product by filling the compartment 1 and snapping the operating member 16 onto the ring 40 by forcing the projections 36 of the ring 19 of the member 16 to be positioned under the rib 43 of said ring 40, such that the operation member 16 is translationally immobilized, but rotationally free; the impermeable skirt 37 coming into the calibrated portion 44 of the body 26.

The annular gear 38 of the element 16 comes into engagement with the grooves 33 of the screw-ring 32 of the element 12.

It is understood that at the moment of the first utilization, it then suffices to turn ring the 19 such that the cooperation of the crown 38 and the grooves 33 thus enables the element 12 to turn and unscrew from body 26, which has the effect of lifting the cap 11 and therefore putting compartments 1 and 2 in communication.

Since the element 16 is translationally immobile during unscrewing, it is obvious that it is element 12 which slides into member 16 by cooperation with the crown 38 and the grooves 33 mentioned above.

In order to dispense the product it then suffices to cut or break the element 21, as in the other embodiments.

Of course, one can provide an anti-return means blocking element 12, e.g., an asperity, in inverse translation.

It is understood that the operation is completely similar to that of the embodiments in FIGS. 1 to 12, the connection element 12 rotationally driven while sliding into the member 16; the latter being translationally immobilized.

As previously mentioned, it is also quite obvious that the screwing system of the embodiment in FIGS. 13 to 16 could be provided on the tube 27 and the cap 11, as already described with respect to FIGS. 1 to 12. Similarly, the screwing system of the embodiments in said FIGS. 1 to 12 could be of the type described in the last embodiment, it being understood that it suffices to provide it on the element 12 or on the cap 11 which are integral.

In addition, the slides of the first embodiments can, of course, be replaced reciprocally by a annular gear and grooves.

What is claimed is:

1. A mixer-conditioner for two components to be separately stored and extemporaneously mixed on their first utilization, comprising:

two compartments, each for containing one of the components;

a communication passage between said two compartments;

an obturation element movable between a closed position and an open position and constructed and arranged, when in the closed position, to seal said communication passage;

a rotary actuation member;

a connection element engaged with said rotary actuation member and integral with said obturation element, with rotation of said actuation member acting to displace said obturation element from said communication passage in order to enable mixing of the components;

said connection element and said actuation member being rotationally integral and translationally free and guided with respect to each other; and rotation elements associated with at least one of said obturation element and said connection element such that the rotation of the actuation member causes displacement of said obturation element to disengage said obturation element from the closed position and causes said connection element to slide into said actuation member.

2. The mixer-conditioner according to claim 1, wherein the communication passage comprises a communication conduit, and said obturation element comprises a cap which closes said communication conduit, when in the closed position, by being pressed thereto.

3. The mixer-conditioner according to claim 2, each compartment of said mixer-conditioner comprising a separate container, said containers being tightly connected to one another by a junction ring, said communication conduit onto which the cap is pressed comprising a neck of one of said containers, said neck of said container being positioned in an open end of the other container.

4. The mixer-conditioner according to claim 2, each compartment of said mixer-conditioner comprising a separate container, said containers being tightly connected to one another by a junction ring, said communication conduit comprising a tubular skirt having first and second ends, the first end extending into one of the containers, and the second end extending into the other container.

5. The mixer-conditioner according to claim 4, wherein said containers further comprise openings comprising necks onto each of which the junction ring is tightly fitted, said junction ring further comprising a generally planar portion from which said tubular skirt extends.

6. The mixer-conditioner according to claim 2, wherein each compartment is positioned within a single container body having an interior, said container body having a bottom wall; one of said compartments comprising a tube which projects into the interior of said container body from the bottom wall of the container body, said tube further comprising an outlet in communication with the interior of the container body; the other compartment being defined by the volume of the interior of the container body outside of the tube; said obturation element being constructed and arranged to close the outlet of said tube when the obturation element is in the closed position.

7. The mixer-conditioner according to claim 6, wherein at least one of said compartments comprises a tube, and said rotation elements associated with at least one of said obturation element and said connection element comprise at least one spiral ramp and at least one projection, each rotation element on said tube adapted to cooperate with another rotation element on the cap such that the operation of the actuation member forces the cap to move away from said tube according to a spiral movement.

8. The mixer-conditioner according to claim 7, wherein the cap comprises an obturation disk connected by fastening hooks to a ring capable of surrounding the tube forming one of the compartments.

9. The mixer-conditioner according to claim 8, comprising at least one guiding lug, and said spiral ramp is open at one end thereof, at least one of said at least one guiding lug and said ramp being configured such that a guiding lug escapes the spiral ramp at the open end of the spiral ramp, thus preventing any subsequent closure, after opening, by way of said lug returning into the ramp.

10. The mixer-conditioner according to claim 9, wherein the open end of the spiral ramp has an asperity capable of being easily crossed by said lug upon opening, but which reinforces the prevention of a return of said lug into said ramp.

11. The mixer-conditioner according to claim 2, wherein said rotation elements associated with at least one of said obturation element and said connection element comprise a spiral ramp and a projection, one being located on said conduit and adapted to cooperate with the other one on said cap such that the rotation of the actuation member forces the cap to move away from said communication conduit.

12. The mixer-conditioner according to claim 11, wherein the cap comprises an obturation disk, connected by fastening hooks to a ring capable of surrounding said communication conduit.

13. The mixer-conditioner according to claim 11, wherein the cap comprises at least one guiding lug and wherein the spiral ramp is open at one end thereof; at least one of said lug and said ramp being configured such that the guiding lug of the cap escapes the spiral ramp at the open end of the spiral ramp, to prevent subsequent return of the obturation element to the closed position, after being moved to the open position, by way of the lug returning into the ramp.

14. The mixer-conditioner according to claim 13, wherein the open end of the spiral ramp has an asperity capable of being easily crossed by the guiding lug upon opening, but which reinforces the prevention of the return of said guiding lug into said ramp.

15. The mixer-conditioner according to claim 1, wherein the actuation member is mounted to an end of one of said two compartments, and said connection element comprises a first end and a second end, said first end being connected to the obturation element, said second end being connected to the actuation member, and said elements associated with at least one of said obturation element and said connection element comprise a screw-ring on said second end constructed and arranged to cooperate with corresponding threading at the end of said compartment to which said actuation member is mounted.

16. The mixer-conditioner according to claim 1, wherein the actuation member is mounted to one of the ends of one of the compartments and has a rotationally free ring accessible from outside of the compartment, said ring comprising slides that extend into the compartment to which said actuation member is mounted to provide rotational engagement and translational guidance, said slides having a length sufficient to enable said connection element to move between the respective closed and open positions of said obturation element.

17. The mixer-conditioner according to claim 16, wherein the actuation member covers and closes an opening of the compartment onto which it is mounted to form a capsule covering said opening, and comprises an openable outlet for distributing product obtained from mixing of the components.

18. The mixer-conditioner according to claim 1, wherein the actuation member is mounted to one of the ends of one of the compartments and comprises a rotationally free ring accessible from outside of the compartment, said ring comprising an annular gear constructed and arranged to provide rotational engagement and translational guidance to the connection element, said connection element comprising grooves adapted to cooperate with said annular gear.

19. The mixer-conditioner according to claim 1, wherein the connection element of the obturation means comprises a perforated plate.

* * * * *